US007543628B2

(12) United States Patent
Matschullat et al.

(10) Patent No.: US 7,543,628 B2
(45) Date of Patent: Jun. 9, 2009

(54) METHOD FOR PREDICTING AND CONTROLLING THE CASTABILITY OF LIQUID STEEL

(75) Inventors: Thomas Matschullat, Eckental (DE); Hans-Jürgen Oeynhausen, Dormagen (DE); Klaus Pronold, Düsseldorf (DE); Hans-Herbert Welker, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/569,781

(22) PCT Filed: Jul. 23, 2004

(86) PCT No.: PCT/EP2004/008300

§ 371 (c)(1),
(2), (4) Date: Feb. 24, 2006

(87) PCT Pub. No.: WO2005/021186

PCT Pub. Date: Mar. 10, 2005

(65) Prior Publication Data

US 2007/0000578 A1 Jan. 4, 2007

(30) Foreign Application Priority Data

Aug. 26, 2003 (DE) ..... 103 39 595

(51) Int. Cl.
*B22D 11/16* (2006.01)

(52) U.S. Cl. ..... 164/452; 164/451; 164/459

(58) Field of Classification Search ..... 164/4.1, 164/451, 452, 459
See application file for complete search history.

(56) References Cited

U.S. PATENT DOCUMENTS

| | | | | |
|---|---|---|---|---|
| 4,919,711 | A * | 4/1990 | Banyai et al. | 75/321 |
| 4,946,644 | A * | 8/1990 | Schumacher et al. | 420/56 |
| 6,383,310 | B1 * | 5/2002 | Otsuka et al. | 148/327 |
| 6,471,789 | B1 | 10/2002 | Ames et al. | |
| 6,588,494 | B1 | 7/2003 | Mazurier et al. | |

FOREIGN PATENT DOCUMENTS

| | | | |
|---|---|---|---|
| CH | 684 172 | A5 | 7/1994 |
| CH | 684172 | * | 7/1994 |
| EP | 0 655 511 | A1 | 5/1995 |

OTHER PUBLICATIONS

C.A. Santos, J.A. Spim and A. Garcia, "Mathematical modeling and optimization strategies (genetic algorithm and knowledge base) applied to the continuous casting of steel", Engineering Applications of Artificial Intelligence, vol. 16, No. 8, 2003, pp. 511-527, XP002301310.

(Continued)

*Primary Examiner*—Kuang Lin

(57) ABSTRACT

The invention relates to a method for predicting and controlling the castability of liquid steel. According to said method, the chemical composition of a melt to be cast is analyzed, an alloy calculation is carried out, alloy elements and/or additions are determined in order to obtain defined material characteristics of the steel, and operating diagrams are drawn up for further treatment of the melt. The interactions of the alloy and/or addition elements, which influence the castability, are taken into account during the alloy calculation as supplemental conditions.

4 Claims, 3 Drawing Sheets

OTHER PUBLICATIONS

Jean-Michael Dengler, Gunter Hartmann, Hans-Werner Jakob and Gerold Lachmann, "Einfluβ der Stahlbegleitelemente auf die Vergieβbarkeit und das Umformverhalten von Beam blanks", Stahl und Eisen, Verlag Stahleisen GmbH, Düsseldorf, vol. 120, No. 3, Mar. 15, 2000, pp. 81-84, XP000945579.

F. Pan, S. Zhou, X. Liang, P. Ding and C. XU, "Thin strip casting of high speed steels", J. of Materials Processing, vol. 63, 1997, pp. 792-796, XP002301311.

Verschueren, P, "CA-AL treatment improves the castability of Al-killed steels at Dillinger Hütterwerke", Steel Times International (Inc. Steel Times), DMG World Media, Redhill, Surrey, GB, vol. 14, No. 1, 1990, pp. 15 and 23, XP000114180.

IC. You, C.N. Chu and R.L. Kashyap, "Expert System for Castability Evaluation: Using a Fixed-Features Based Design Approach" Robotics and Computer Integrated Manufacturing, Elsevier Science Publishers Bv., Barking, GB, vol. 6, No. 3, 1989, pp. 181-189, XP000670446.

* cited by examiner

METHOD FOR PREDICTING AND CONTROLLING THE CASTABILITY OF LIQUID STEEL

CROSS REFERENCE TO RELATED APPLICATIONS

This application is the US National Stage of International Application No. PCT/EP2004/008300, filed Jul. 23, 2004 and claims the benefit thereof. The International Application claims the benefits of German Patent application No. DE10339595.4 filed Aug. 26, 2003. All of the applications are incorporated by reference herein in their entirety.

FIELD OF THE INVENTION

The invention relates to a method for predicting and controlling the castability of liquid steel by analyzing the chemical composition of a melt to be cast, carrying out an alloy calculation and defining alloying elements and/or additives for obtaining specific material properties of the steel, and determining operating diagrams for further treatment of the melt.

BACKGROUND OF THE INVENTION

Such methods are used in the manufacture of steel. The liquid steel is supplied by a steelworks. The secondary metallurgy is then performed in a ladle furnace arranged upstream of a thin-strip continuous casting machine. In addition, certain secondary metallurgical equipment is provided in/on the ladle furnace for metallurgical treatment of the liquid steel. This equipment can be used to perform precise analyses of the melt and also for precise thermal conditioning of the melt. The liquid steel is treated in the ladle furnace by adding alloying agents, slag formers, reduction agents, desulfurization agents, etc., where these additives are added automatically or manually. In addition, the slag can be treated by adding oxygen or by rinsing with an inert gas such as argon. The liquid steel can be stirred electromagnetically in the ladle, and electrical energy can also be supplied to it via carbon electrodes. The arc passing from the electrodes to the melt causes the alloying elements to melt and enables the thermal conditioning of the melt.

In order to manufacture from the melt a specific steel quality having defined material properties such as strength, toughness, hardness, corrosion resistance etc., it is necessary to add metal and non-metal alloying elements and additives. Mathematical models are used for this purpose, said models calculating from a latest analysis of the melt the material composition of the required alloying elements and additives in order to obtain a very specific steel quality. The proportions of the metal and non-metal elements are thereby set in a defined band. Additional strength formulae that take account of the interactions between the alloying elements and additives in the melt are applied in a quality center in order to assess the expected material properties. These formulae are mainly empirical. In conventional works comprising steelworks, ladle furnace and continuous casting machine, such calculations of the interactions of the additives and alloying elements are at best performed offline in quality centers. The strength formulae and empirical formulae cited in the literature are simplified models for the complex interactions of the alloying elements and additions that influence the material properties of the cast steel.

Thin-strip continuous casting machines mainly manufacture steel strips having a strip thickness of up to 10 mm. The melt is conditioned following an analysis in a similar way to in conventional machines. It has been found, however, that in thin-strip continuous casting machines, the castability of the liquid steel is far more problematic than in conventional casting machines, e.g. in continuous casting machines for slabs.

Liquid steel is designated as uncastable if the cast strip cracks e.g. when casting in the thin-strip continuous casting machine, the cast material exhibits surface defects or structural faults of a general nature and it causes plant breakdowns as a result of the uncastable liquid steel e.g. sticking to the casting rollers etc. Until now, attempts to solve these problems with the castability have largely been made in the thin-strip continuous casting machine itself. These attempts were only partially successful, however, because many melts proved uncastable.

SUMMARY OF THE INVENTION

The invention is therefore based on the problem of improving the method for predicting and controlling the castability of liquid steel so as to significantly reduce the failure rate.

In order to solve this problem, in a method of the type specified in the introduction it is provided according to the invention that the interactions of the alloying elements and/or additive elements influencing the castability are taken into account in the alloy calculation as supplementary conditions.

The invention is based on the surprising discovery that interactions between the alloying elements and/or additive elements exist that are not only relevant to the mechanical properties but also to the castability of the melt. These are new and different interactions that are independent of the known interactions taken into account up to now. According to the invention, the usual interactions must be taken into account in the alloy calculation as before, i.e. the proportions of the individual alloying elements and additives must lie within defined valid ranges. In addition, the supplementary conditions, which are derived from the interactions and influence the castability, must be taken into account.

In the method according to the invention it has proved particularly advantageous if at least two alloying elements and/or additives at a time are related to each other to determine the effect of their proportions on the castability. Two materials at a time are related to each other in an x-y coordinate system on the basis of data gathered from melts already cast. The relative proportions of the melts, for example in percent or in PPM, are plotted along the axes. In addition, a tolerance band specifying the minimum value and the maximum value for each element is specified for each alloying element and/or each additive in the form of straight lines parallel to the axes. When the interactions are not taken into account, a rectangular intersecting set defined by the intersecting straight-line segments is obtained. In addition, the current proportions of the two alloying elements represented are plotted in the coordinates system, this instantaneous value being symbolized by a point. It is then immediately obvious in the graph whether the melt does or does not lie within the tolerance band. In order to obtain a castable melt, however, it is not enough for the melt to lie within the permitted range. According to the invention, those interactions that influence the castability of the melt must also be taken into account. In order to be able to take into account the data gathered on the melts, it is provided in the method according to the invention that the information "castable" or "uncastable" is assigned to each cast melt.

Using this information, it is provided in the method according to the invention that, based on the data gathered on cast melts and based on the alloying elements and/or additives related to each other, at least one permitted range, within which a castable melt is expected, is defined for the proportions of alloying elements and/or additives. This permitted range is a subset of the aforementioned range for which only those interactions that influence the material properties are taken into account. It has proved, however, that the first, larger range cannot be fully used because, owing to the interactions that influence the castability, problems arise in many cases so that the melt is uncastable. Hence, the range that specifies the permitted proportions of the individual alloying elements and additives must be adjusted to take into account the data gathered on melts already cast, i.e. must be reduced in size. If the gathered data is taken into account, with each melt being assigned the information "castable" or "uncastable", then it is possible to define specific ranges as permitted in which those melts lie that have proved castable in the past.

In order to minimize the computing overhead, it can be provided in the method according to the invention that the permitted range for the proportions is defined as an intersecting set of a plurality of inequalities. The whole x-y surface of the coordinate system can be divided into two sections by an inequality, namely into a valid and an invalid region. An area on one side of a straight line is the graphical equivalent of an inequality. In addition, the coordinate axes can be used to define permitted ranges, because, since the alloying elements can only ever assume positive values, only the first quadrant need be considered.

In the method according to the invention, it will be necessary in general to define the permitted range as an intersecting set of a plurality of intersecting straight lines. Assuming the axes of the coordinate system are not taken into account, at least three straight lines are required in order to define the range uniquely. In practice it has proved that more than three, in particular four, inequalities are often required for a sensible definition of the range.

The method according to the invention can be implemented particularly quickly and in part automatically if the interactions of the alloying elements and/or additive elements are implemented as mathematical models in a computer system. The calculation and graphical representation of the ranges require comparatively little computing time, so that it can be established immediately after performing a melt analysis whether the proportions of the individual alloying elements and additives lie in the permitted range or whether additional treatment steps are required. According to a further embodiment of the invention, it can also be provided that the method according to the invention for predicting and controlling the castability of liquid steel is performed automatically by the computer system iteratively.

It can also be provided in the method according to the invention that fuzzy logic methods are used for the mathematical models. Alternatively or additionally it can be provided that neural networks are used for the mathematical models.

In order to keep the computation overhead for implementing the method within bounds, it can be provided that a preselection of those alloying elements and/or additive elements that influence the castability of the melt is made for the alloy calculation. Studies have shown that only some of the alloying elements influence the castability. If a melt comprises ten elements, it would be necessary to investigate the first element with the remaining nine elements, the second element with eight elements, etc., so that a large number of element pairs would need to be taken into account. It is therefore practical to take into account only those alloying elements and/or pairs of alloying elements and/or additive elements that actually influence the castability of the melt. The number of element pairs to be taken into account can be reduced significantly in this way. This also reduces the number of inequalities i.e. boundary conditions to be taken into account, which simplifies the solution of the equation systems.

According to one version of the method according to the invention, it can be provided that interactions between the following alloying elements and/or additives are taken into account in the alloy calculation: C, Si, Mn, S, Al, N, Zn, $O_2$. It has been found that the restriction to these eight alloying elements and/or additives is sufficient to achieve a considerable improvement in the castability.

The method according to the invention can be embodied in such a way that interactions of the following pairs of alloying elements and/or additives are taken into account in the alloy calculation: $N/O_2$, $Zn/O_2$, S/Zn, C/Zn, Mn/S, Mn/N, Si/C, Al/C, in particular $Si/O_2$, $S/O_2$, $Al/O_2$, S/C, N/C. In theory, 28 pairs can be combined from the eight selected alloying elements cited. It has proved, however, that only 13 of these pairs influence the castability. Of these, five pairs of alloying elements or additives have a serious effect on the castability. Even if only these five pairs are taken into account with a view to achieving an efficient method it is still possible to achieve excellent results as regards predicting and controlling the castability.

In the method according to the invention, it can be provided that the permitted range for one or each alloying element and/or one or each additive that results in a castable melt and the actual value measured in the melt are shown on the same graph. The actual value can be plotted in the graph as a point or a cross or the like, so that an operator can see at a glance whether it does or does not lie within the permitted range. This graph is shown for each of the value pairs to be taken into account, so that an operator identifies whether all the boundary conditions that influence the castability are satisfied, or else he identifies for which alloying elements further treatment is required e.g. by adding more of the alloying element. In addition, it can be provided that the permitted range for an alloying element and/or an additive resulting from the desired material properties is shown.

It is useful if in the method according to the invention an updated actual value of an alloying element or an additive is shown after a treatment step carried out on the melt. This makes it immediately possible to check whether the treatment step has led to the desired success.

Likewise, it can be provided that after a plurality of treatment steps carried out on the melt, the respective actual values of an alloying element or an additive are shown as points connected together by straight-line segments.

The method according to the invention can be used particularly advantageously in a thin-strip continuous casting machine operating on the principle of the twin-roller casting process.

In addition, the invention relates to a control device for a secondary metallurgical machine, in particular a ladle furnace, having a means for analyzing the chemical composition of a melt to be cast, a means for carrying out an alloy calculation to define alloying elements and/or additives in order to obtain specific material properties of the steel, and means for determining operating diagrams for further treatment of the melt.

According to the invention, the control device is embodied to carry out the method described.

BRIEF DESCRIPTION OF THE DRAWINGS

Further advantages and details of the invention are described using an exemplary embodiment with reference to the drawings, in which.

DETAILED DESCRIPTION OF THE INVENTION

Figure 1:
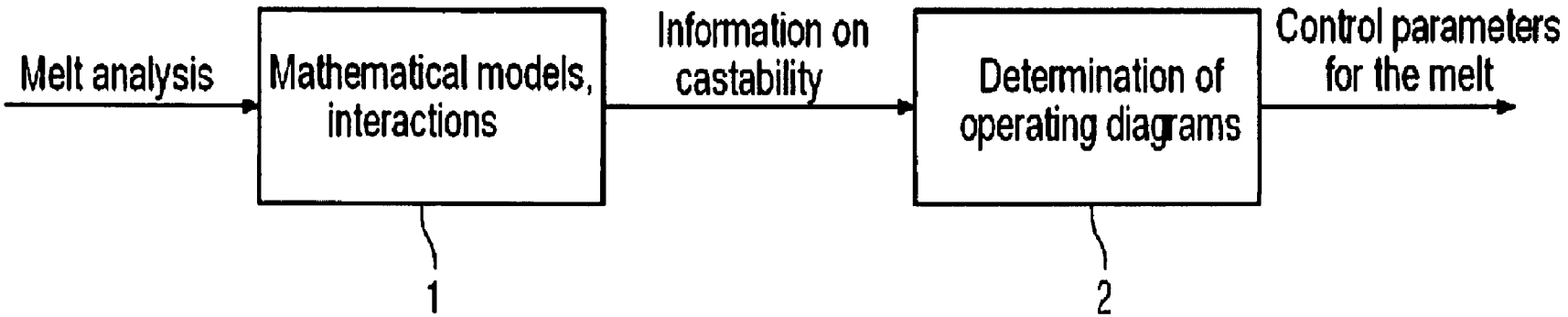
FIG. 1 shows the flow diagram for the method according to the invention.

The diagram shown in FIG. 1 shows the flow diagram of the method for predicting and controlling the castability of liquid steel.

The method starts with a melt analysis to determine the chemical composition of the melt to be cast. For the melt analysis, the melt is held in a ladle furnace arranged upstream of a thin-strip continuous casting machine. The metallurgical treatment of the liquid steel for setting the required material parameters is carried out in the ladle furnace. Electrical and/or thermal energy can be supplied to the melt via graphite electrodes in order to trigger specific chemical reactions. The melt can be stirred electromagnetically in the ladle furnace. Alloying elements and additives such as slag formers, reduction agents, desulfurization agents etc. are added automatically or manually. In addition, there is the facility to rinse the liquid steel with an inert gas such as argon or to supply oxygen.

After carrying out the melt analysis, an alloy calculation 1 is performed in order to set metal and non-metal alloying elements in a defined band. The alloy calculation is used to calculate the type and quantity of the additives and alloying elements in order to be able to modify and treat the batch of liquid steel currently in the ladle furnace so that it meets the requirements. First, the individual alloying elements must be present in the correct proportion i.e. in the correct concentration, where tolerance bands having a lower and upper limit exist for each element. In this method, interactions between the alloying elements and additives that influence the castability are additionally taken into account. The mathematical models used in the alloy equation 1 take into account these interactions, so that the melt is extremely likely to be castable after the treatment.

From past experience it was found that when using conventional methods, although a melt did satisfy the requirement regarding the material properties of the finished steel, surface defects still occurred or the steel adhered to the casting rollers, for example, so that the melt had to be rejected as uncastable.

Information about the castability is available after performing the alloy calculation 1. If it was calculated that the melt is castable, the method continues with the determination of operating diagrams 2 for the electric-arc furnace tapping and the ladle furnace. If the result of the alloy equation 1 is "uncastable", more alloying elements or additives, for example, must be added, or treatment steps such as the addition of an inert gas or oxygen are required. Depending on the prediction as to the castability of the liquid steel, the operating diagrams for operating the ladle furnace are determined, and stipulations are made as to the addition of metal and non-metal additives and the further treatment. The inclusion of the interactions that influence the castability results in supplementary conditions for the operating diagrams or to a change in an operating diagram. The operating diagrams are determined for the ladle furnace and the secondary metallurgy.

This procedure is advantageous with regard to selecting the melts. If a melt proves to be uncastable, or if the measures to produce the castability are too complex, then a decision can be made to reject the melt. In this case, the melt would need to be processed again in the steel works. This procedure avoids costs of mistakes made in production and saves resources.

If it is identified that the melt can be brought into a castable state by metal or non-metal additives, and if this procedure is not too complex, then the castability of the melt can be achieved using the determined operating diagrams for the ladle furnace and the secondary metallurgy. In this case as well there is the advantage of avoiding costs of mistakes in production and saving resources.

If it is identified that the melt is castable, the melt can be treated in the ladle furnace using the operating diagram intended for it, and can be released for the thin-strip continuous casting machine.

If it is identified that the melt can be set even more beneficially metallurgically by taking into account the interactions influencing the material properties, this can be done while maintaining the castability. This has the resultant advantage that the melt can be set optimally metallurgically taking into account the castability. Once again in this case, costs of mistakes in production are avoided and resources protected.

As can be seen in FIG. 1, control parameters for the further treatment of the melt are obtained through the determination of the operating diagrams 2.

Figure 2:
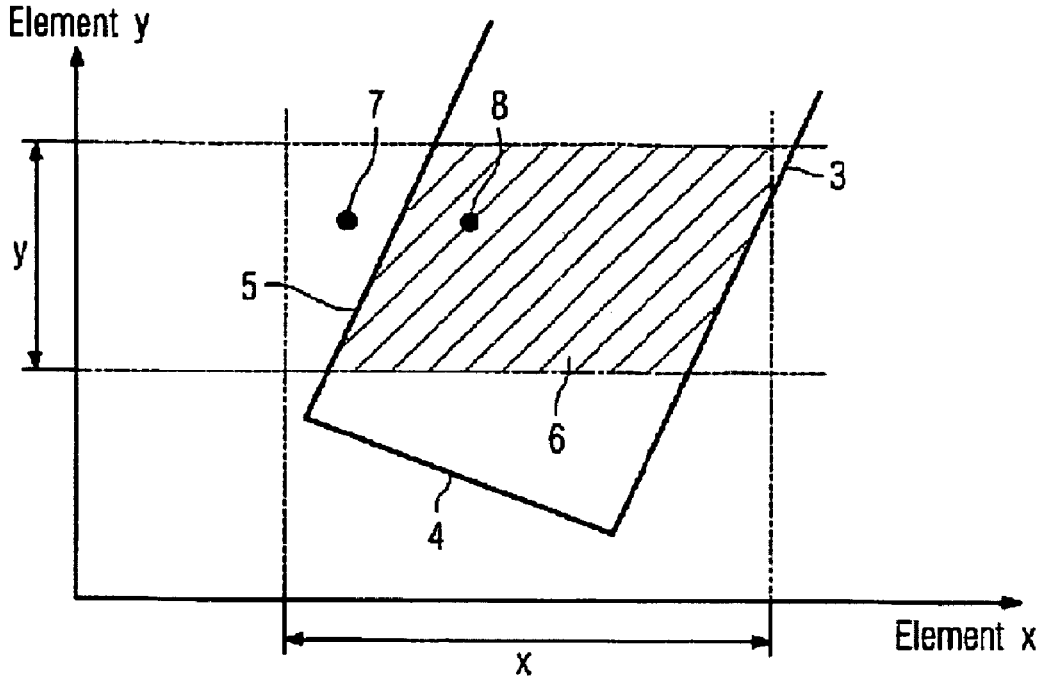
FIG. 2 shows a graph of the ranges of two alloying elements where the interactions are taken into account.

FIG. 2 shows a graph of the ranges of two alloying elements where the interactions that influence the castability are taken into account.

The ranges for the proportions of the elements x and y respectively are plotted along the x-axis and y-axis respectively. The range of each element is limited by two straight lines parallel to the axes, which define the minimum and maximum concentration respectively of the given material in the melt. If the analysis value of the melt lies within the intersecting set of these straight lines, the requirements for the material properties are satisfied.

It is not sufficient, however, merely to take into account the requirements for the material properties. In addition, the interactions that influence the castability must be considered. In FIG. 2, the castable region is shown by the straight-line segments 3, 4, 5. A melt that not only satisfies the material properties requirements but also the castability requirements must lie in the intersecting set of both areas. This valid region 6 is shown hatched in FIG. 2.

From a melt analysis, a value 7 is known that satisfies the conditions for the conventional casting operation as far as the material properties are concerned, because it lies within the range of the elements x and y. It does not lie within the valid region 6, however, so it is likely that this melt will be uncastable.

The analysis of another melt has produced the value 8 that lies within the valid area 6. This means that not only are the material properties requirements satisfied, because the two elements x and y lie within the respective tolerance ranges, but also the castability is established because the value 8 lies within the straight-line segments 3, 4, 5. As far as these elements x and y are concerned, the melt can be cast.

This investigation, explained using the elements x and y by way of example, must be carried out for all relevant value pairs, all of which must lie within the valid range. The following value pairs must be investigated as a minimum: $Si/O_2$, $S/O_2$, $Al/O_2$, S/C, N/C. If the investigation of these conditions leads to the result that all the elements lie within the valid ranges, it is highly likely that the melt is castable. If any value does not lie within the valid range, another treatment step is required, for example by adding an alloying element. It must be realized, however, that the proportions or, as the case may be, concentrations of the other alloying elements and additives to be taken into account are also affected by the addition of an alloying element. These interrelationships are generally non-linear and complex. The mathematical models that take into account these interactions that influence the castability therefore include methods such as neural networks or fuzzy logic. Hence in general an iterative calculation, i.e. an optimization calculation is carried out in order to achieve the objective using the minimum quantity of alloying elements and/or at minimum cost.

Figure 3:
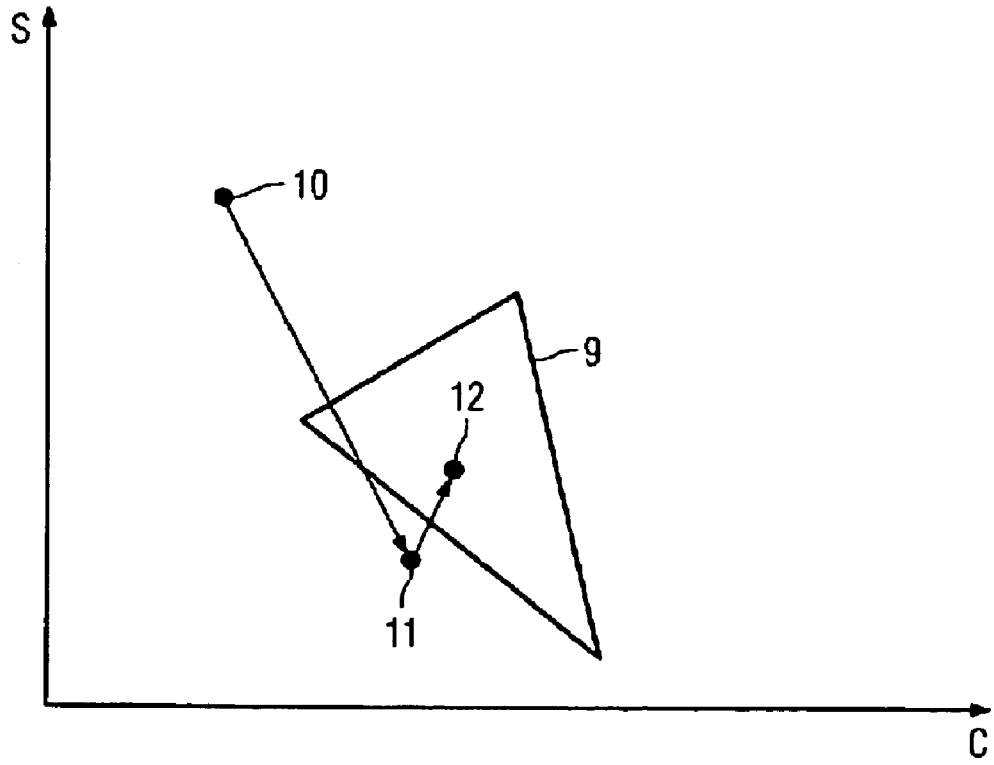
FIG. 3 shows a diagram showing the proportions of the elements sulfur and carbon dioxide, and the castable range.

FIG. 3 shows a diagram of the proportions of the elements sulfur and carbon. The concentration of carbon in the melt is plotted along the x-axis, and the concentration of sulfur along the y-axis. The triangular area 9 shown in FIG. 3 shows the region of castability of the element pair sulfur/carbon. The first analysis value 10 lies outside the triangular area 9 i.e. the melt is not castable in this state. Hence a treatment of the melt is carried out, for instance by adding an additive in order to increase the proportion of carbon and reduce the proportion of sulfur. An analysis is carried out again after this treatment, resulting in the analysis value 11. Although the proportions of these two elements now lie near the region of castability, a second treatment step is still necessary until the analysis value 12 is obtained. The analysis value 12 lies within the triangular area 9, i.e. within the castable region. It must be ensured at the same time, however, that the other elements and/or pairs of elements to be taken into account lie within their valid regions.

Figure 4:
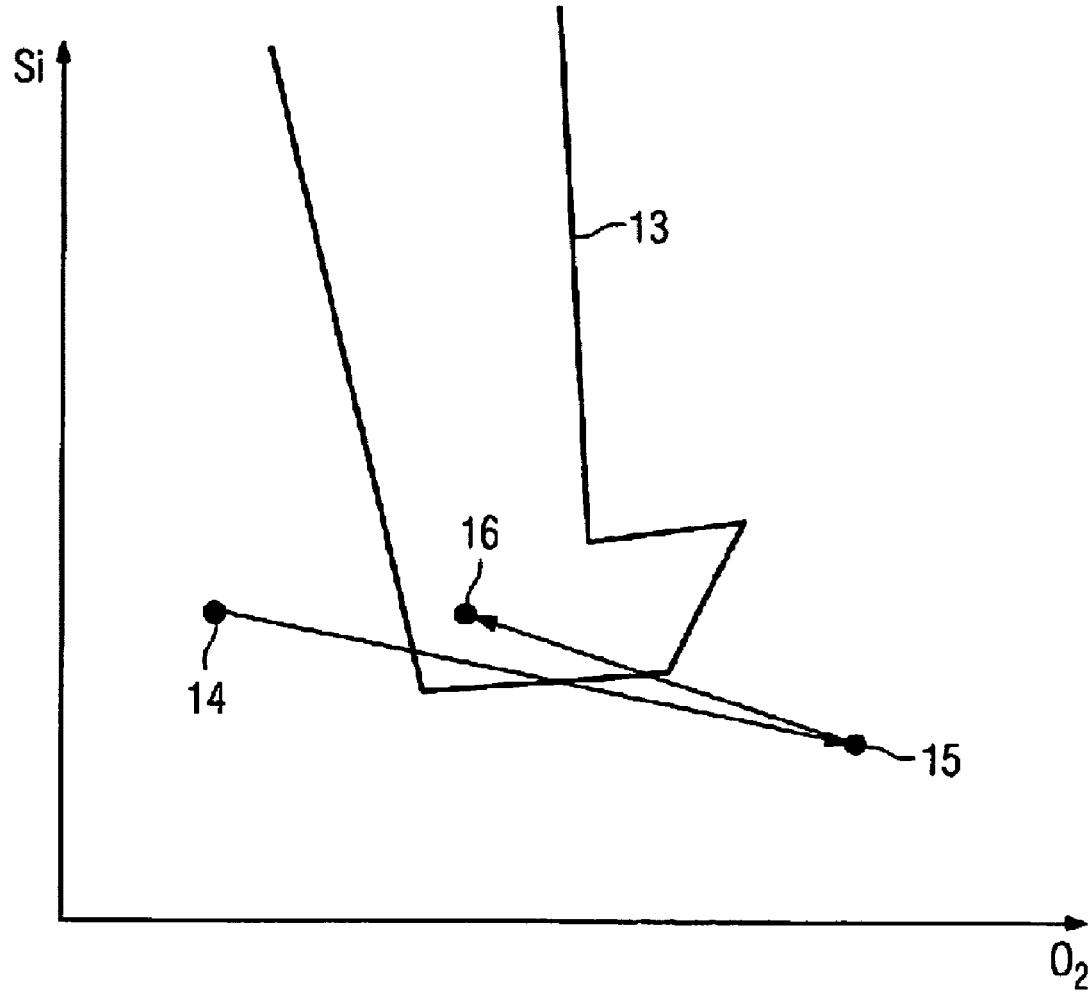
FIG. 4 shows a diagram showing the proportions of the elements silicon and oxygen, and the castable range.

FIG. 4 shows the proportions of the elements silicon and oxygen and the castable region.

Unlike in FIG. 3, the castable region 13 in FIG. 4 is defined by a plurality of straight-line segments that do not form an enclosed area. In some cases, the castable region can also be defined by parabola segments or segments of trigonometric functions. The aim should, however, be to define the valid regions by straight-line segments in order to keep the computing overhead within bounds.

The first analysis value 14 lies outside the castable region 13. After treatment of the melt the analysis value 15 was obtained, in which although the oxygen content was increased, it was too high, with the result that the value 15 again lay outside the castable region 13. The analysis value 16 that meets the conditions for the elements silicon and oxygen was only measured after another treatment step.

In the method it is provided that the diagrams for the five most important pairs of elements are displayed simultaneously to the operator on a display. In addition, the analysis values for individual alloying elements or additives can be displayed as numerical values in a table. By this means the operator can see at a glance which values are already acceptable and which values require further treatment.

After each melt the measured values of said melt are saved in a database so that the mathematical models can have recourse to a constantly growing database, thereby increasing the prediction probability.

The invention claimed is:

1. A method for controlling the castability of liquid steel, the method comprising:

selecting each pair of alloying elements from the group consisting of $Si/O_2$, $S/O_2$, $Al/O_2$, S/C, and N/C;

for the each pair of alloying elements from the group consisting of $Si/O_2$, $S/O_2$, $Al/O_2$, S/C, and N/C, establishing a first range of relative concentration limits in a melt such that a subsequent casting of the melt is likely to exhibit acceptable mechanical properties;

for the each pair of alloying elements from the group consisting of $Si/O_2$, $S/O_2$, $Al/O_2$, S/C, and N/C, establishing a respective second range of relative concentration limits as a subset of the first range of relative concentration limits such that a subsequent casting of the melt is further likely to be castable; and casting a steel melt comprising the each pair of alloying elements from the group consisting of $Si/O_2$, $S/O_2$, $Al/O_2$, S/C, and N/C having relative concentration limits within the second range of relative concentration limits for the each pair of alloying elements.

2. The method of claim 1, further comprising:

for the each pair of alloying elements from the group consisting of $Si/O_2$, $S/O_2$, $Al/O_2$, S/C, and N/C, displaying the first range on a graph illustrating concentration of a first element along a first axis and concentrations of a respective second element along a second axis;

for the each pair of alloying elements from the group consisting of $Si/O_2$, $S/O_2$, $Al/O_2$, S/C, and N/C, displaying the respective second range on the graph as a sub-area of the first range; and for the each pair of alloying elements from the group consisting of $Si/O_2$, $S/O_2$, $Al/O_2$, S/C, and N/C, displaying a measured relative concentration of the first element and the respective second element in the melt as a point on the graph.

3. The method of claim 1, used in a thin-strip continuous casting machine according to a twin roller casting process.

4. The method of claim 1, further comprising treating the steel melt by increasing an amount of a first element in a first pair from the group consisting of $Si/O_2$, $S/O_2$, $Al/O_2$, S/C, and N/C if a measured relative concentration of the first pair in the melt falls outside the respective second range.

* * * * *